United States Patent [19]

Russell

[11] 4,155,129

[45] May 22, 1979

[54] PAN TYPE BOTTOM DISCHARGE TOILET

[76] Inventor: Harold J. Russell, 804 Mountain Ave., Ojai, Calif. 93023

[21] Appl. No.: 889,259

[22] Filed: Mar. 23, 1978

[51] Int. Cl.[2] ..... E03D 11/02; E03D 11/18

[52] U.S. Cl. ..... 4/429; 4/424; 4/442; 4/440

[58] Field of Search ..... 4/442, 318, 424, 440, 4/429, 432, 331, 300, 421

[56] References Cited

U.S. PATENT DOCUMENTS

| | | | |
|---|---|---|---|
| 863,778 | 8/1907 | Brooks | 4/429 |
| 3,102,274 | 9/1963 | Witvroun | 4/421 |
| 3,454,967 | 7/1969 | Corliss | 4/318 |
| 3,719,958 | 3/1973 | Wilheim | 4/424 |
| 3,883,903 | 5/1975 | Vanden Broek | 4/440 |
| 3,905,049 | 9/1975 | Stokes et al. | 4/318 |
| 3,922,729 | 12/1975 | Ashley | 4/331 |
| 3,986,216 | 10/1976 | Davis et al. | 4/432 |

*Primary Examiner*—Henry K. Artis

*Attorney, Agent, or Firm*—Poms, Smith, Lande & Rose

[57] ABSTRACT

A bottom discharge toilet in which a trap is formed integrally with the toilet base. While the trap plays no role in the flushing action of the toilet itself, it is adapted to receive the discharge from other plumbing fixtures and thereby to serve as a single, common trap for such fixtures. By directing the received discharge through the interior of the toilet, the trap also assists in keeping the toilet outlet line clear. To further reduce the overall cost, the toilet is formed in several interlocking pieces as a kit which can be conveniently shipped and handled, and then assembled on-site. A novel water inlet valve operates in cooperation with a flushing mechanism to clear the toilet and refill the bowl with a minimum of water consumption.

8 Claims, 8 Drawing Figures

PAN TYPE BOTTOM DISCHARGE TOILET

BACKGROUND

A. Field of the Invention

This invention relates to plumbing fixtures, and more particularly to a low cost toilet of the bottom discharge type.

B. Description of the Prior Art

The cost of plumbing can be a significant portion of the construction cost for a house, particularly in the case of prefabricated houses designed for on-site assembly. Adding to the cost of the plumbing fixtures themselves is the cost of transporting them to the construction site and associated handling charges. Another item of cost involves the usual practice of providing redundant traps for individual fixtures, such that each sink, toilet, tub, etc. has its own trap. Extra materials and labor are required for this excess trapping capacity.

Many existing toilets also use unnecessary amounts of water, more than is required to merely clear the toilet. The water usage rate is particularly important in areas without a municipal water supply, where water must typically be hand carried to a roof cistern to provide the necessary pressure. The question of water pressure is related to that of water usage. In many areas of the world the available water pressure is within the range of about 3–30 kilopascal (4–40 p.s.i.), as opposed to a standard of about 420 kilopascal (60 p.s.i.) in the United States. Toilets in these areas should be able to operate under the lower water pressures available, without using excessive amounts of water. There is also frequently a problem of clogging in the toilet outlet line, stemming both from the relatively low water pressure, and the fact that the toilet paper used in such areas is frequently rough in texture.

Bottom discharge toilets, in which water is held in a bowl by a retaining pan and then released by tilting the pan during flushing, have proven to be quite economical in terms of both cost and water consumption. However, currently available toilets do not adequately solve all of the problems mentioned above. For example, the very fact that a toilet uses water efficiently may lead to downstream clogging problems because less water is available to clear the outlet lines.

The redundant trap problem has been addressed in a previous toilet of the non-bottom discharge type. Inlets were provided in the toilet trap to receive water from other plumbing fixtures, and thereby avoid the need for separate traps on such fixtures. This toilet, however, was not of the simple bottom discharge type, in which the discharge drops by gravity through an opening in the bottom of the toilet and a trap is not used. Rather, the trap was supported by wire on the back of the toilet and received the toilet discharge as well as the discharge from the other plumbing fixtures.

SUMMARY OF THE INVENTION

In view of the above problems associated with the prior art, it is an object of the present invention to provide a novel and improved low cost toilet of the bottom discharge type, in which a trap is not normally used.

Another object is the provision of such a toilet which is capable of operating under low water pressures, with a small amount of water consumption.

An additional object is the provision of such a bottom discharge toilet in which savings are achieved by eliminating the need for traps in other plumbing fixtures.

Still another object is the provision of a bottom discharge toilet capable of cooperating with other plumbing fixtures to help keep the toilet outlet line clear.

Another object is the provision of a bottom discharge toilet which may be very conveniently transported, handled, and assembled, thereby keeping its overall cost down.

These and other objects of the invention are achieved in a bottom discharge toilet which comprises a base, a reservoir means mounted above the base, the reservoir means including outlet openings for releasing water held therein, a controlled water inlet to the reservoir means, an open bowl means carried below the reservoir means for receiving water therefrom, a pivotable pan for releasably retaining water within the bowl means, and a discharge orifice at the bottom of the base below the bowl means. A trap is provided on the base to provide trapping action for plumbing fixtures other than the toilet. The trap includes an inlet means to receive the discharge from other plumbing fixtures, and an outlet means directing such discharge into the interior of the base after passage through the trap. A common trap is thereby provided for each of the other plumbing fixtures, and the discharge from each of such fixtures is employed in keeping the toilet outlet clear.

In a preferred embodiment, the trap is formed integrally with the base, and includes a vent for the plumbing system. The toilet is also provided in kit form, broken down into interlockable pieces which may be readily assembled on site.

The invention also contemplates an improved inlet valve comprising a pivotable flap mounted within the inlet passage and normally blocking the flow of water therethrough, a reciprocable plunger extending inwardly through an opening in the inlet means in axial alignment with the flap, a seal for the opening, an operating handle, and means for transmitting motion of the handle to move the plunger and open the flap. The handle also controls pivoting of the retaining pan, ensuring coordination between the valve and the pan. In a preferred embodiment the handle is mounted in alignment with the plunger axis, and includes a cam which engages the plunger.

DESCRIPTION OF THE DRAWINGS

Further advantages and features of the invention will be apparent to those skilled in the art from the following detailed description thereof, taken together with the accompanying drawings, in which.

DESCRIPTION OF A PREFERRED EMBODIMENT

Figure 1:
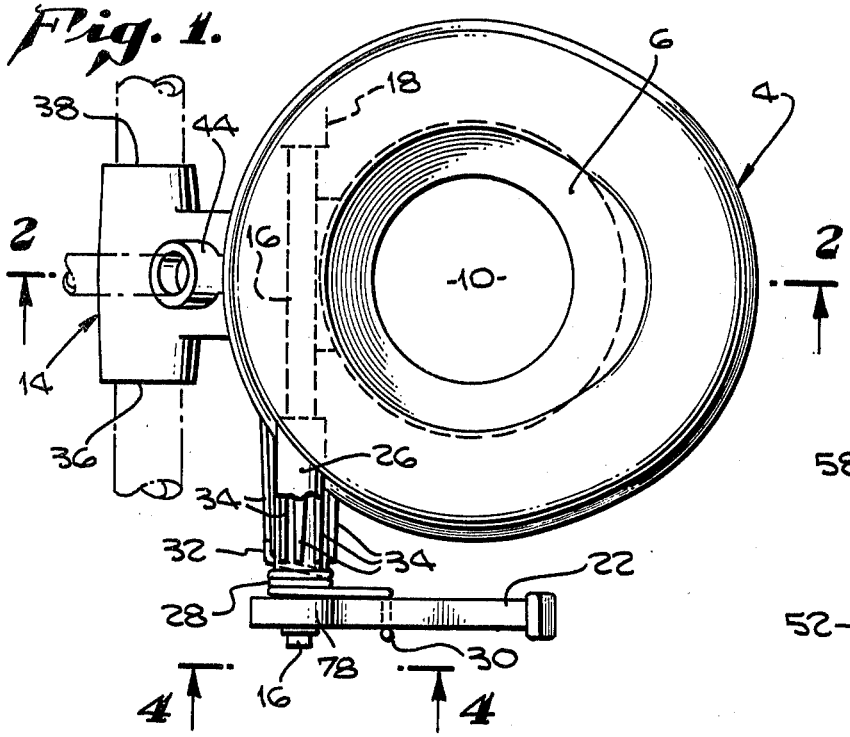
FIG. 1 is a plan view of a bottom discharge toilet incorporating the features of the invention.
Figure 2:
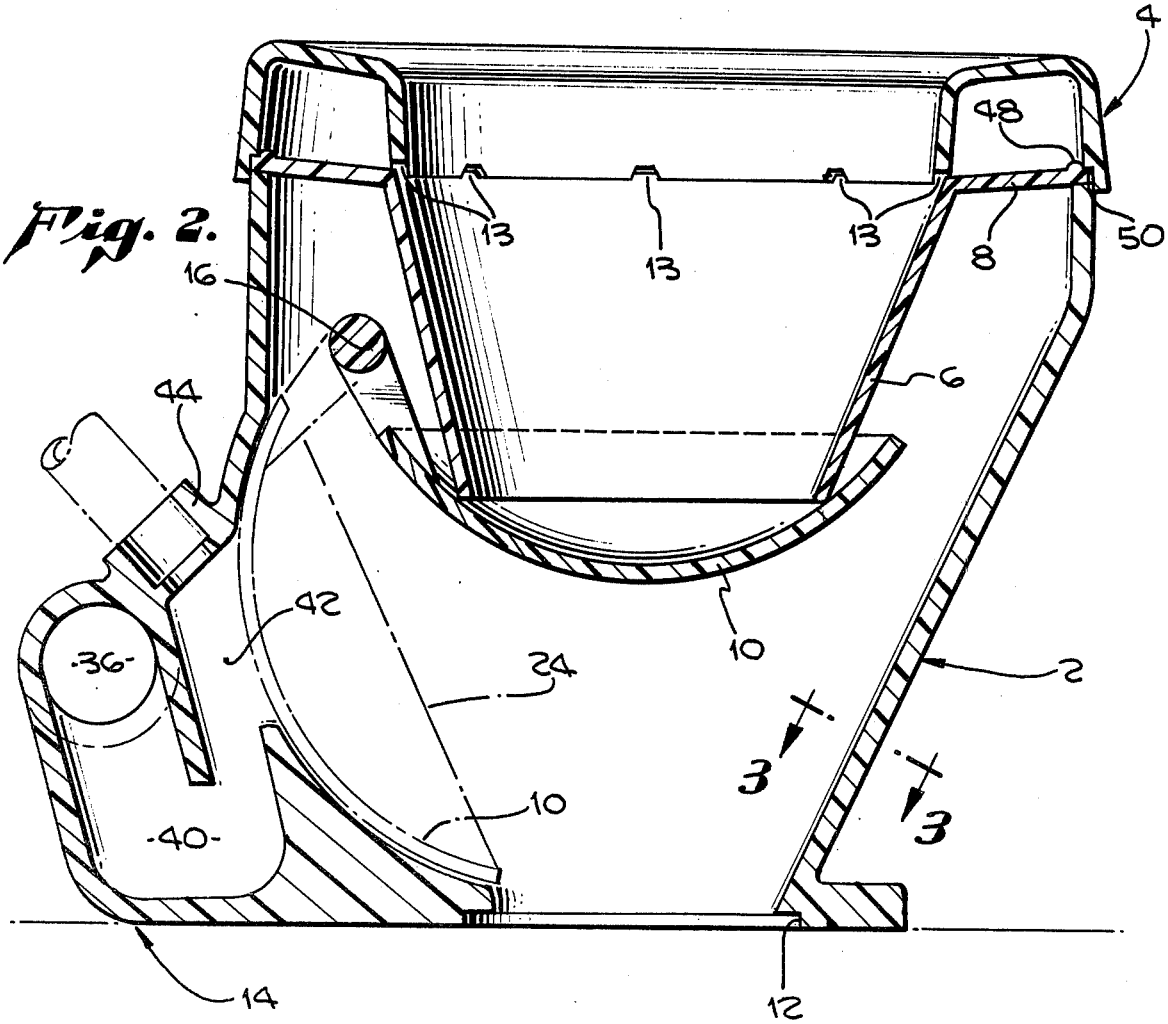
FIG. 2 is a sectional view taken along the line 2—2 of FIG. 1.

Referring to FIGS. 1 and 2, a bottom discharge toilet is shown with its principal components comprising a base 2, a combined seat and reservoir section 4 mounted above the base, a conically shaped bowl 6 with an annular rim 8 at its upper end held between base 2 and reservoir 4, and a retaining pan or dish 10 held below the bowl and sealing the lower end thereof to retain water in the bowl. The bottom of base 2 is open, forming an annular orifice 12 through which the toilet discharges. A plurality of small openings 13 are distributed around reservoir 4, extending through its lower wall. These openings provide outlets to release water entering the reservoir and distribute the water evenly around the circumference of bowl 6. As described below, water is permitted to flow into reservoir 4 only while the toilet is being actively flushed.

At the rear of the toilet and formed integrally therewith is a trap mechanism 14 which, as described hereinafter, serves both as a trap for other plumbing fixtures, and as a source of supplemental discharge water to help keep the toilet outlet clear.

Retaining pan 10 is connected to a pivot axle 16, one end of which is rotatable lodged in a receiving socket piece 18 and the other end of which extends through a bushing member 20. An operating handle or lever 22 engages the outer end of axle 16, whereby a downward rotational movement of handle 22 causes axle 16 to rotate around its axis in a clockwise direction as seen in FIG. 2. This in turn causes retaining pan 10 to pivot to the position 24 indicated in phantom lines, opening the bottom of bowl 6 and permitting its contents to drop out through orifice 12.

Handle 22 also operates an inlet valve which controls the flow of water into reservoir 4. The valve is carried at the end of a pipe 26 which extends outwardly from the side wall of reservoir 4. It is described in detail below in conjunction with FIGS. 4–6.

Figures 4, 5, 6, 7:
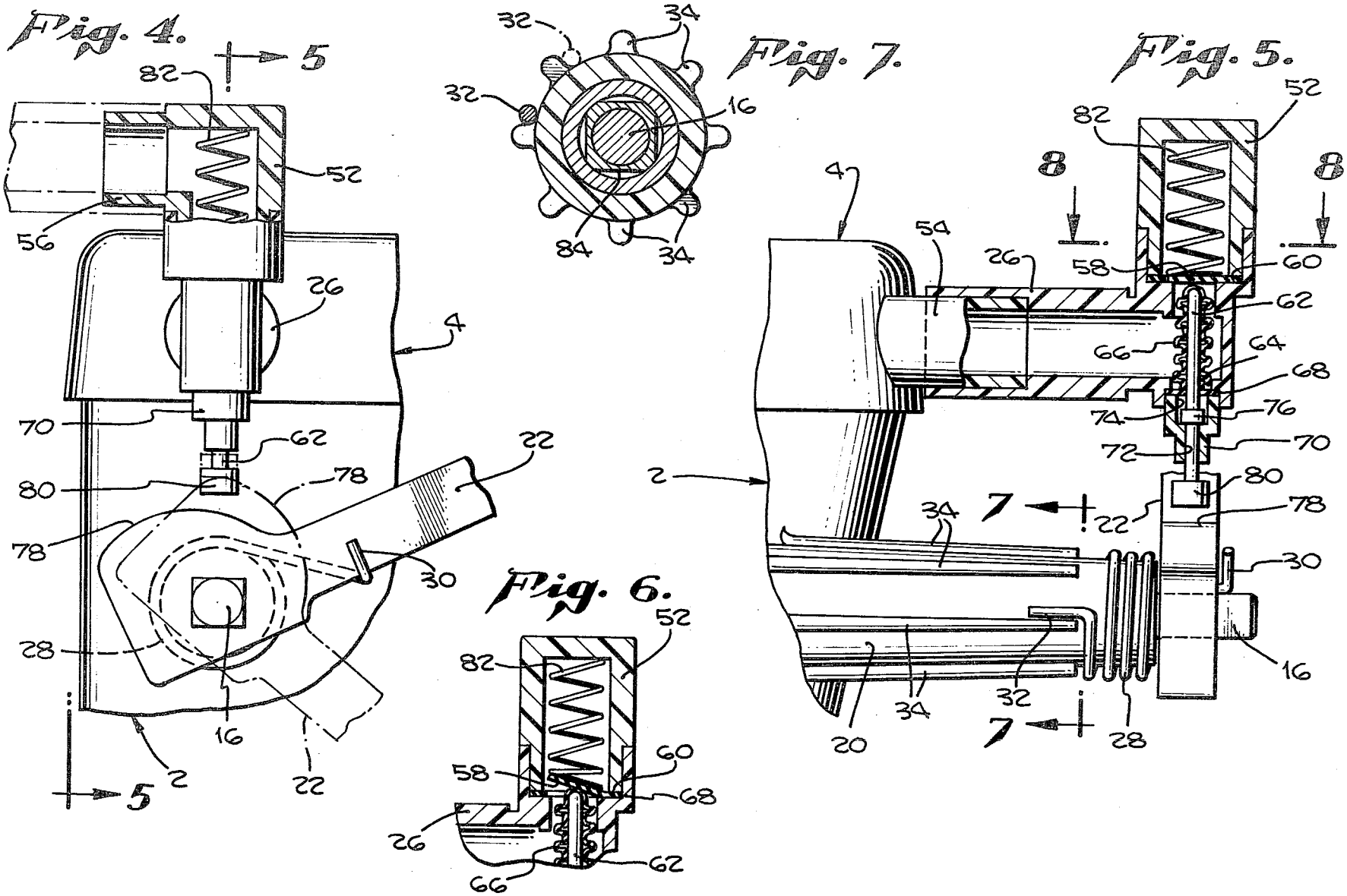
FIG. 4 is a partially sectioned elevation view of the toilet operating handle and inlet valve.
FIG. 5 is a partially sectioned view taken along the line 5—5 of FIG. 4.
FIG. 6 is a fragmentary sectional view showing the inlet valve in an open position.
FIG. 7 is a sectional view taken along the line 7—7 of FIG. 5.

Referring now to FIGS. 1, 4 and 5, a coil spring 28 is wound around the outer portion of bushing 20, one end 30 of the spring engaging the underside of handle 22, and the other end 32 lodged between two of a series of longitudinal fins 34 distributed around the circumference of bushing 20. Spring 28 is held in tension and causes handle 22 to return to its original position with pan 10 sealing the bottom of bowl 6, after handle 22 has been operated and released. The spring tension can be adjusted by moving spring end 32 to a position between a different pair of fins from that shown in the drawings.

Trap 14 includes inlets 36 and 38, which are adapted to be connected by pipes (shown in phantom lines in FIG. 1) to receive the discharge from other plumbing fixtures; a trapping path 40 of conventional configuration; and an outlet orifice 42 in the side wall of base 2. Trap 14 thus serves as a common trap for each of the other plumbing fixtures with which it is used, directing the discharge from such fixtures through the interior of the toilet to outlet orifice 12. In this manner a large amount of water is made available for keeping the toilet outlet line clear, without increasing the amount of water consumed in flushing. A vent 44 is formed on the upper side of the trap to provide a vent for the plumbing system integral with the toilet itself, rather than through the house plumbing.

Figure 3:
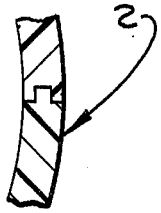
FIG. 3 is a fragmentary sectional view taken along the line 3—3 of FIG. 2.
Figure 8:
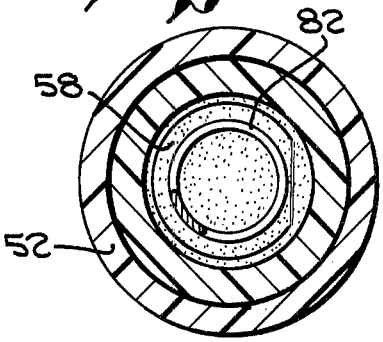
FIG. 8 is a sectional view taken along the line 8—8 of FIG. 5.

The toilet is preferably manufactured in the form of separate components and shipped as a kit to the construction site, where it can be quickly assembled. To this end, base 2 is preferably formed in two separate pieces, divided along the section line 2—2 of FIG. 1. Other separate pieces include the reservoir/seat 4, bowl 6, retaining pan 10, and the handle and inlet valve elements. Interlocking means such as key and groove 48, 50 are provided at the junctures of the various pieces to ensure a tight fit and to facilitate assembly. A tongue and groove arrangement, shown in FIG. 3, is also provided at the intersection of the two base pieces to achieve a tight and secure fit.

The toilet components are preferably formed by injection molding of foamed high impact styrene or acriconitrile butadiene styrene (ABS). The valve is formed from the same material, but under a higher pressure injection molding for greater dimensional precision. Trap 14 is formed integrally with corresponding portions of base 2. The various pieces can be nested after molding to achieve a compact shipping package, and to prevent breakage. The parts are held together with an adhesive, which for styrene components is preferably acetone based solvent packaged as an aerosol to assure complete coverage.

Referring now to FIGS. 4 and 5, the preferred embodiment of an inlet valve for the toilet is shown. Outlet pipe 26 extends from a valve housing 52 and fits over the pipe stud 54, the latter element extending through the side wall of reservoir 4. Water enters the valve through an inlet pipe 56, and flows downwardly through housing 52 to the upper side of a pivotable flap 58, preferably formed from rubber. Flap 58 is held on one side over an annular shelf 60, and normally prevents water from flowing through the valve. Immediately below the flap is a vertically oriented plunger or piston 62 which extends out of the bottom of housing 52 through an orifice 64. A rubber sealing gasket 66 prevents water from leaking through orifice 64. The gasket is provided at its lower end with an annular rim 68 which is held in place between a plug 70 and the outer surface of the valve housing surrounding orifice 64. Plug 70 has an internal bore 72 for plunger 62 which widens at its upper end to a cavity 74 of greater cross-sectional dimension than plunger 62. A collar 76 grids the plunger within cavity 74 to restrict the length of its reciprocating stroke.

The hub of handle 22 is formed in the shape of an outward extending cam 78 where it engages axle 16. Cam 78 engages a bearing member 80 at the lower end of plunger 62 when the handle is operated. Handle 22 is normally held under the influence of coil spring 28 in an upright position shown in solid lines in FIG. 4. In this position cam 78 is out of contact with bearing member 80, and plunger 62 is at a lowered position. As handle 22 is rotated downward to the position shown in phantom lines, cam 78 comes into contact with bearing member 80 and pushes plunger 62 upward to the position shown in FIG. 6 and in phantom lines in FIG. 4. This causes flap 58 to pivot upwardly and thereby permit water to flow through the valve, as indicated by the arrows in FIG. 6, and thence into reservoir 4. The area through which water can flow into reservoir 4 when flap 58 is open is preferably greater than the total area of reservoir outlet openings 13, thereby insuring an accumulation of water within the reservoir so that water will continue to flow out through openings 13 after the valve has been shut.

When handle 22 is released spring 28 returns it to its original upright position, permitting plunger 62 to fall and flap 58 to close under the influence of the water flowing into the valve. A light coil spring 82 may be provided between the upper surface of flap 58 and the inside roof of valve housing 52 to increase the flap closing speed, and to hold the flap down when the toilet is not being operated. This is particularly useful in areas with low water pressures.

Referring now to FIG. 7, a cross-section of bushing 20 is shown. A bearing sleeve 84 is retained within the bushing to provide a low friction bearing surface for axle 16. Alternate positions for spring end 32, by which the return force on handle 22 and also the sealing force of retaining pan 10 against bowl 6 may be adjusted, are indicated.

In operation, pan 10 is normally held in sealing relation to the lower end of bowl 6, and water is held within the bowl. After the toilet has been used, flushing is accomplished by momentarily pushing down on handle 22. This pivots pan 10 to an open position, permitting the waste material held therein to fall out through orifice 12, and also rotates cam 78 to lift plunger 62 and open flap 58. Water flows through the valve, over the bottom surface of reservoir 4, and then out through openings 13 to wash the bowl.

When handle 22 is released, pan 10 is returned to its original position sealing the bottom of bowl 6. Water continues to flow out of reservoir openings 13 for a short period, and accumulates at the bottom of the bowl where it is held until the next flushing operation. Releasing handle 22 also rotates cam 78 back to its original position; this permits plunger 62 to drop and flap 58 to close, shutting off the flow of water through the valve. With the toilet construction shown, complete flushing can be achieved with a consumption of as little as one liter of water, even in areas with low water pressures.

While a particular embodiment of the invention has been shown and described, numerous modifications and variations may occur to one skilled in the art in light of the above teachings. It is therefore intended that the scope of the inventor be limited only in and by the terms of the appended claims.

I claim:

1. In a bottom discharge toilet comprising a base, a reservoir means mounted above said base, said reservoir means including outlet openings for releasing water therein, a controlled water inlet to said reservoir means, an open bowl means carried below said reservoir means for receiving water therefrom, means having open and closed positions for releasably retaining water within said bowl means, said water retaining means in a closed position forming a seal with said bowl means, and a discharge orifice at the bottom of said base below said bowl means, the improvement comprising:

a trap means carried on said base, said trap means being configured to provide trapping action for plumbing fixtures other than said toilet, and including inlet means adapted to receive the discharge from said other plumbing fixtures, an outlet means directing said discharge into the interior of said base above said discharge orifice after passage through said trap means, and means for enabling a flow of water from said inlet means to said outlet means and for preventing a flow of gas from said outlet means to said inlet means, whereby a common trap means is provided for each of said other plumbing fixtures, and the discharge thereof is employed in keeping the toilet outlet clear.

2. The toilet of claim 1, said trap means being formed integrally with said base.

3. The toilet of claim 1, and further including a toilet vent means provided in said trap means.

4. A low cost toilet kit comprising a plurality of base pieces adapted to be fitted together to form a base for a bottom discharge toilet, a reservoir piece forming an annular reservoir and including therein outlet openings for release of water in said reservoir, an open bowl piece mountable on said base below said reservoir piece, a pan piece mountable below said bowl piece in sealing relationship therewith to retain water therein, means for tilting said pan from a closed to an open position to enable a discharge of liquid from said bowl piece, and a valve means for controlling the flow of water into said reservoir, each of said pieces including means for guidingly interlocking with other pieces of said kit to facilitate the assembly thereof, said base pieces including complementary portions of a trap means adapted to provide trapping action for plumbing fixtures other than said toilet, said trap means when assembled including inlet means adapted to receive the discharge from said other plumbing fixtures, an outlet means directing said discharge into the interior of said base after passage through said trap means, and means for enabling a flow of water from said inlet means to said outlet means and for preventing a flow of gas from said outlet means to said inlet means.

5. In a toilet comprising a base, a reservoir means mounted above said base, a water inlet means for enabling water flow into said reservoir means during a flushing operation, and a flushing means, said reservoir means including a plurality of openings for releasing water therein, the improvement comprising means for controlling the flow of water through said inlet means, said control means comprising:

a pivotable flap mounted within said inlet means and normally blocking the flow of water therethrough to said reservoir means, a reciprocable plunger extending inwardly through an opening in said inlet means in axial alignment with said flap, means sealing said opening, a pivotable operating handle mounted on the exterior of said toilet, and motion transmission means moveable against said plunger, in response to operation of said handle, to cause said plunger to pivot said flap and thereby enable water to flow through said inlet means into said reservoir, the flow of water urging the flap back to a blocking position when the handle is released.

6. In a bottom discharge toilet comprising a base, a reservoir means mounted above said base, said reservoir means including outlet openings for releasing water therein, a water inlet to said reservoir means, an open bowl means carried below said reservoir means for receiving water therefrom, a pivotable drop pan for releasably retaining water within said bowl means, and a discharge orifice at the bottom of said base below said bowl means, wherein the improvement comprises means for controlling the flow of water into said reservoir means in coordination with the release of water from said bowl means, said means comprising:

a pivotable flap mounted within said inlet means and normally blocking the flow of water therethrough to said reservoir means, a reciprocable plunger extending inwardly through an opening in said inlet means in axial alignment with said flap, means sealing said opening, a pivot axle for said drop pan, an operating handle mounted to said pivot axle for pivoting said drop pan and releasing water retained in said bowl means when the operating handle is operated, and motion transmission means moveable against said plunger, in response to operation of said handle, to cause said plunger to pivot said flap and thereby enable water to flow through said inlet means into said reservoir, the flow of water urging the flap back to a blocking position when the handle means is released.

7. The toilet of claims 5 or 6, wherein said handle is mounted in alignment with the plunger axis, and said motion transmission means comprises a cam means carried on said handle in engagement with said plunger means, said cam means translating a pivoting handle movement to a longitudinal plunger movement.

8. The toilet of claims 5 or 6, and further including spring means urging said handle toward a non-flushing position.

* * * * *